US012264860B2

(12) United States Patent
Hu et al.

(10) Patent No.: US 12,264,860 B2
(45) Date of Patent: Apr. 1, 2025

(54) WATER CHILLER, WATER OUTPUT ADJUSTMENT METHOD AND AIR CONDITIONING SYSTEM

(71) Applicant: Gree Electric Appliances, Inc. of Zhuhai, Guangdong (CN)

(72) Inventors: Jiang Hu, Guangdong (CN); Lifeng Shen, Guangdong (CN); Pei Qian, Guangdong (CN); Baolin Zhou, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 564 days.

(21) Appl. No.: 17/628,663

(22) PCT Filed: Jul. 6, 2020

(86) PCT No.: PCT/CN2020/100378
§ 371 (c)(1),
(2) Date: Jan. 20, 2022

(87) PCT Pub. No.: WO2021/036510
PCT Pub. Date: Mar. 4, 2021

(65) Prior Publication Data

US 2022/0252315 A1 Aug. 11, 2022

(30) Foreign Application Priority Data

Aug. 30, 2019 (CN) ..... 201910818683.4

(51) Int. Cl.
*F25B 49/00* (2006.01)
*F24F 11/88* (2018.01)
(Continued)

(52) U.S. Cl.
CPC ..... *F25B 49/00* (2013.01); *F24F 11/88* (2018.01); *F24F 11/89* (2018.01); *F24F 2140/12* (2018.01); *F25B 2700/19* (2013.01)

(58) Field of Classification Search
CPC .. F24F 11/49; F24F 11/88; F24F 11/89; F24F 2140/12; F25B 2700/19; F25B 49/00
See application file for complete search history.

(56) References Cited

U.S. PATENT DOCUMENTS 5,101,639 A 4/1992 Wruck et al.
9,631,848 B2 4/2017 Vandermeulen et al.
(Continued)

FOREIGN PATENT DOCUMENTS

CN 101089503 A 12/2007
CN 101165429 A 4/2008
(Continued)

OTHER PUBLICATIONS

MT CN204511834 Jul. 29, 2015 (Year: 2015).*
MT CN110118405 Aug. 13, 2019 (Year: 2019).*

*Primary Examiner* — Henry T Crenshaw
(74) *Attorney, Agent, or Firm* — The Webb Law Firm

(57) ABSTRACT

A water chiller, a water output adjustment method, and an air conditioning system. The water chiller includes: at least two cooling towers used in parallel, a water pressure balance adjustment circuit, and a main control hoard, where each of the at least two cooling towers includes a water pressure pre-adjustment circuit, the main control board is configured to control the water pressure pre-adjustment circuit to realize real-time water output adjustment of the each of the at least two cooling towers, and control the water pressure balance adjustment circuit to achieve a water output balance adjustment among-multiple cooling towers.

20 Claims, 8 Drawing Sheets

(51) Int. Cl.
*F24F 11/89* (2018.01)
*F24F 140/12* (2018.01)

(56) References Cited

U.S. PATENT DOCUMENTS

| | | | | |
|---|---|---|---|---|
| 2009/0153337 | A1* | 6/2009 | Cordesses | G01M 15/08 701/102 |
| 2017/0196051 | A1* | 7/2017 | Lena | H05B 45/395 |
| 2021/0318044 | A1* | 10/2021 | Yuan | F25B 49/00 |

FOREIGN PATENT DOCUMENTS

| | | | |
|---|---|---|---|
| CN | 103277875 | A | 9/2013 |
| CN | 104458811 | A | 3/2015 |
| CN | 204511843 | U | 7/2015 |
| CN | 204710614 | U | 10/2015 |
| CN | 205304760 | U | 6/2016 |
| CN | 106524410 | A | 3/2017 |
| CN | 107062712 | A | 8/2017 |
| CN | 207247326 | U | 4/2018 |
| CN | 207609548 | U | 7/2018 |
| CN | 110118405 | A | 8/2019 |
| CN | 110542254 | A | 12/2019 |
| WO | 2010009498 | A1 | 1/2010 |

* cited by examiner

WATER CHILLER, WATER OUTPUT ADJUSTMENT METHOD AND AIR CONDITIONING SYSTEM

CROSS-REFERENCE TO RELATED APPLICATIONS

The present disclosure is a U.S. National Stage Application under 35 U.S.C. § 371 of International Patent Application No. PCT/CN2020/100378, filed on Jul. 6, 2020, and claims priority of Chinese application No. 201910818683.4, filed on Aug. 30, 2019, the disclosures of both of which are hereby incorporated into this disclosure by reference in their entirety.

BACKGROUND OF THE DISCLOSURE

The disclosure relates to the field of air conditioning systems, in particular to a water chiller, a water output adjustment method, and an air conditioning system.

DESCRIPTION OF RELATED ART

A refrigeration unit in an air conditioning system realizes heat exchange through water cooling and air cooling. The refrigeration unit adopts a condenser for cooling mode, and plays an important role in a refrigeration system. A water chiller in the refrigeration unit is widely used in the air conditioning system. There are a piston chiller, a centrifugal chiller, a screw chiller, a modular chiller, etc. It is very important to measure input and output water pressures of the condenser, especially when cooling towers are used in parallel, in which case it is necessary to adjust water inputs of the cooling towers through valves to achieve a balance of water outputs. Usually, pressure gauges and thermometers are set on an inlet valve and an outlet valve of the water chiller to achieve control and detection

SUMMARY OF THE DISCLOSURE

According to some embodiments of the present disclosure, a water chiller is provided, comprising: at least two cooling towers used in parallel, a water pressure balance adjustment circuit, and a main control board, wherein each of the at least two cooling towers comprises a water pressure pre-adjustment circuit, the main control board is configured to control the water pressure pre-adjustment circuit to realize real-time water output adjustment of the each of the at least two cooling towers, and control the water pressure balance adjustment circuit to achieve a water output balance adjustment among multiple cooling towers.

According to further embodiments of the present disclosure, an air conditioning system is provided, comprising: a water chiller according to any of the foregoing embodiments.

According to still other embodiments of the disclosure, a water output adjustment method of a water chiller is provided, comprising: for a pump of each of at least two cooling towers, monitoring an output water pressure of the pump of the each of the at least two cooling towers in real time; comparing the output water pressure with a control water pressure to obtain a first comparison result; adjusting the water output of the pump of the each of the at least two cooling towers according to the first comparison result.

According to still other embodiments of the disclosure, a water output adjustment method of a water chiller is provided, comprising: monitoring an output water pressure of a pump of each of at least two cooling towers in real time; for the pump of the each of the at least two cooling towers, comparing an output water pressure of the pump of the each of the at least two cooling towers with a control water pressure to obtain a comparison result; adjusting the water output of the pump of the each of the at least two cooling towers according to the comparison result corresponding to the pump of the each of the at least two cooling towers to realize a balance of output water pressures among the at least two cooling towers.

The other features of this disclosure and their advantages will become clear through a detailed description of the exemplary embodiments of this disclosure with reference to the accompanying drawings below.

BRIEF DESCRIPTION OF THE DRAWINGS

The accompanying drawings, which are comprised to provide a further understanding of the present disclosure and are incorporated in and constitute apart of this specification, illustrate embodiments of the invention, and together with the illustrative embodiments of the present application serve to explain the present disclosure, but are not limitation thereof. In the drawings.

DETAILED DESCRIPTION

Below, a clear and complete description will be given for the technical solution of embodiments of the present disclosure with reference to the figures of the embodiments. Obviously, merely some embodiments of the present disclosure, rather than all embodiments thereof, are given herein. The following description of at least one exemplary embodiment is in fact merely illustrative and is in no way intended as a limitation to the invention, its application or use. All other embodiments obtained by those of ordinary skill in the art based on the embodiments of the present disclosure without creative efforts shall fall within the protection scope of the present disclosure.

The inventors have found that in the method of setting pressure gauges and thermometers on an inlet valve and an outlet valve of the water chiller to achieve control and detection, a water output adjustment of the water chiller according to the result of detection has hysteresis and imbalance, and the abnormal water pressure in the operation of the water chiller is prone to potential safety hazards.

In order to solve the technical problem of hysteresis and imbalance of the water output adjustment of the water chiller, the present disclosure provides a water chiller, a water output adjustment method and an air conditioning system.

The present disclosure provides a water output adjustment method of a water chiller comprising multiple cooling towers. In this method, through detecting input and output water pressures of the water chiller and comparing them with a control water pressure, a water pressure adjustment is performed on the water chiller in real time, and the detected input and output water pressures are fed back to a main control board of the water chiller, which realizes a balance adjustment of the input and output water pressures through control logic to ensure the balance of cooling water outputs. Through extracting the input and output water pressures of multiple cooling towers and comparing them with a control water pressure, a balance adjustment of the input and output water pressures is achieved for multiple cooling towers, thereby avoiding potential safety hazards caused by abnormal water pressure during the operation of the water chiller.

A water chiller comprises at least two cooling towers used in parallel, a water pressure balance adjustment circuit, and a main control board, each of the at least two cooling towers comprises a water pressure pre-adjustment circuit, the main control board is configured to control the water pressure pre-adjustment circuit to realize real-time water output adjustment of the each of the at least two cooling towers, and control the water pressure balance adjustment circuit to achieve a water output balance adjustment among multiple cooling towers.

Figure 1:
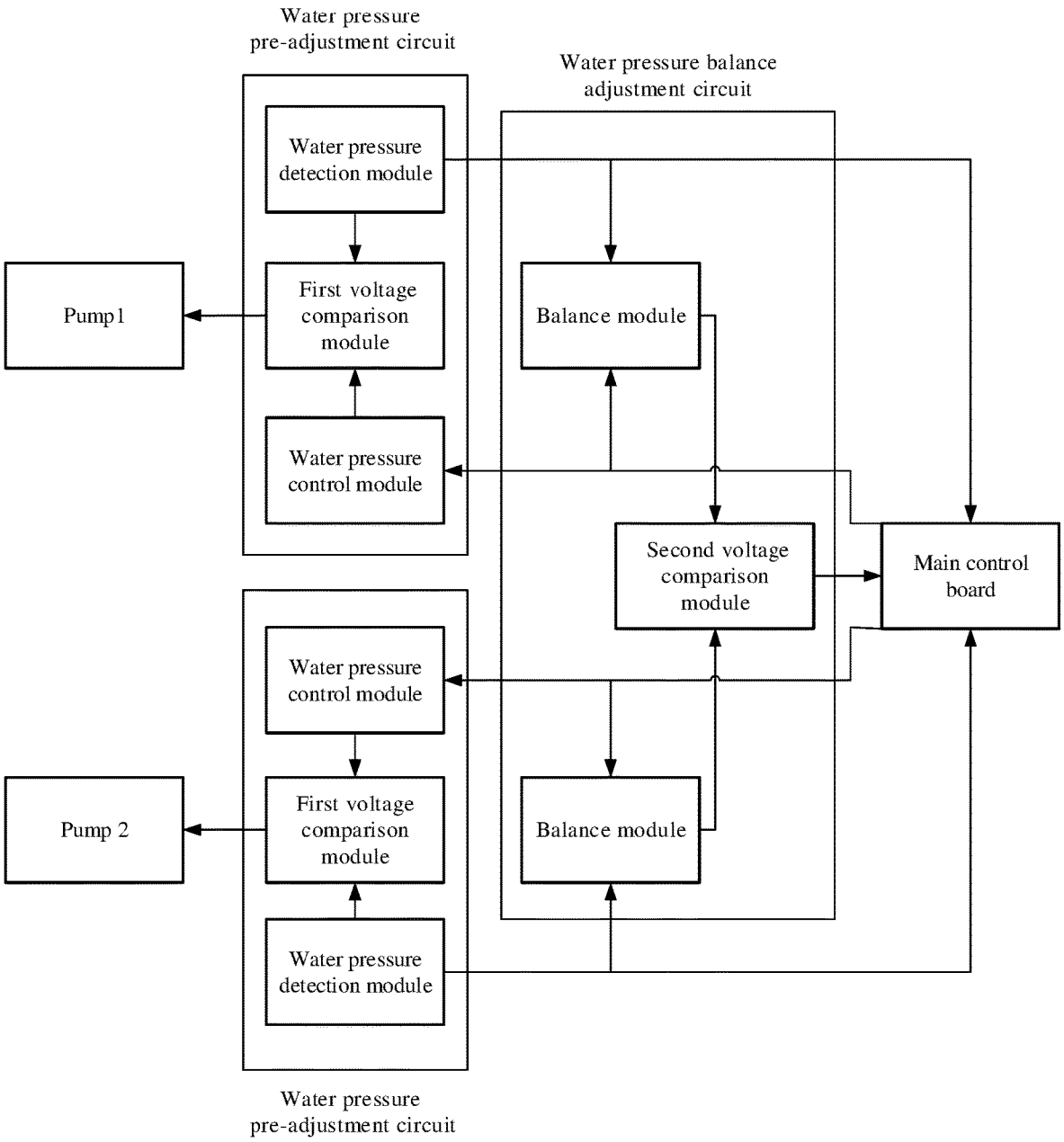
FIG. 1 is a schematic block diagram according to some embodiments of the present disclosure.

Taking the water chiller comprising two cooling towers used in parallel as an example, FIG. 1 is a schematic block diagram of a water output adjustment of the water chiller. The water chiller comprises two cooling towers used in parallel, a water pressure balance adjustment circuit and a main control board. Each of the two cooling towers comprises a pump (pump 1 and pump 2 are located in different cooling towers respectively), and each of the two cooling towers corresponds to a water pressure pre-regulation circuit.

Each water pressure pre-adjustment circuit comprises: a water pressure detection module, a water pressure control module and a first comparison module. The water pressure detection module is configured to detect input and output water pressures of the water chiller, and transmit a water pressure detection signal to the first comparison module, the water pressure balance adjustment circuit and the main control board respectively. The water pressure control module receives a water pressure control signal from the main control board, generates a control signal, and then transmits the control signal to the first comparison module. The first comparison module compares the water pressure detection signal with the control signal, and transmits a comparison result to a pump control circuit, which controls the pump to perform a balance adjustment of input and output water pressures according to the comparison result, so as to realize a real-time water pressure adjustment. The main control board receives the water pressure detection signal and realizes a balance adjustment of the input and output water pressures through control logic to ensure the balance of cooling water outputs.

In some embodiments, the water pressure detection module is configured to detect an output water pressure of the water chiller, generate a water pressure detection signal, and send the water pressure detection signal to the first comparison module. The water pressure control module is configured to receive a water pressure control signal from the main control board, generate a control signal, and send the control signal to the first comparison module. The first comparison module is configured to compare the received water pressure detection signal with the control signal to obtain a first comparison result, transmit the first comparison result to a pump control circuit, which controls the water output of the pump according to the first comparison result.

In some embodiments, the water pressure detection module is configured to detect an input water pressure and an output water pressure of the water chiller, generate a first water pressure detection signal and a second water pressure detection signal respectively, and send the first water pressure detection signal and the second water pressure detection signal to the main control board. The main control board is configured to control the balance between the input water pressure and the output water pressure according to the first water pressure detection signal and the second water pressure detection signal.

Figure 2:
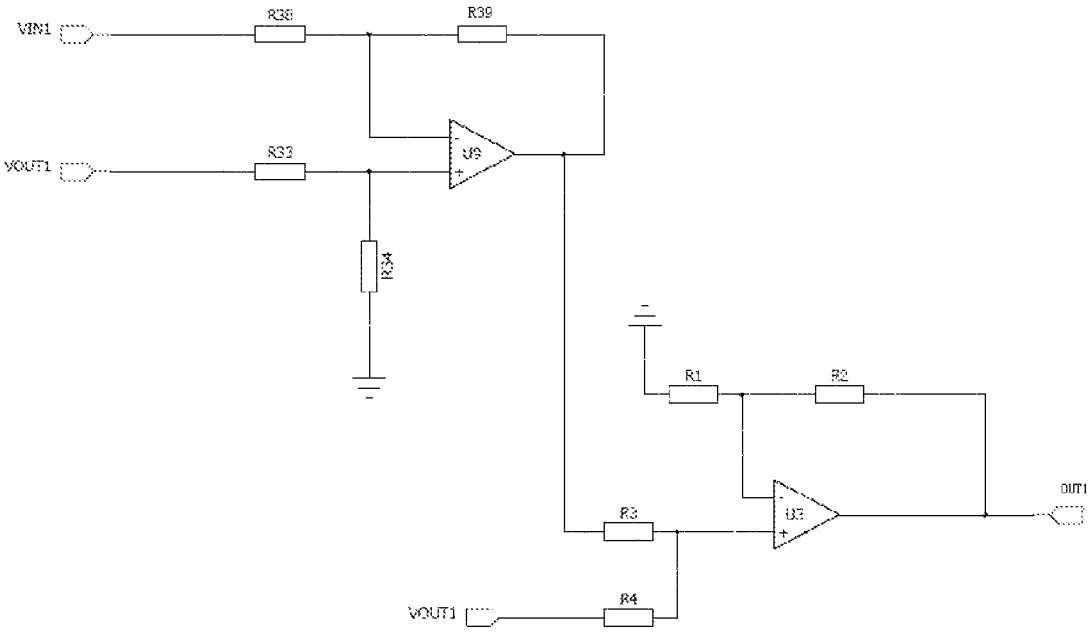
FIG. 2 is a circuit diagram of a first comparison module according to some embodiments of the present disclosure.

The first comparison module comprises a subtractor and an adder. FIG. 2 is a circuit diagram of the first comparison module, wherein the subtractor is composed of an operational amplifier U9, and resistors R38, R33, R34 and R39. A negative input terminal of the operational amplifier U9 forms an input terminal VIN1 of a voltage comparator through a resistor R38, wherein the input terminal is connected to an output terminal of the water pressure detection module to receive a water pressure detection signal. A positive input terminal of the operational amplifier U9 forms another input terminal VOUT1 of the voltage comparator through the resistor R33, which is connected to an output terminal of the water pressure control module to receive a control signal output by the water pressure control module. The output terminal of the operational amplifier U9 is further grounded through the resistor R34. A subtraction operation is performed on the water pressure detection signal and the control signal through the operational amplifier U9, and an operation result is output to the adder from the output terminal. The output terminal of the operational amplifier U9 is connected to the negative input terminal of the operational amplifier U9 through the resistor R39.

The adder is composed of an operational amplifier U3, and resistors R1, R2, R3 and R4. A positive input terminal of the operational amplifier U3 is connected to the output terminal of the subtractor through the resistor R3, and the positive input terminal of the operational amplifier U3 is further connected to the output terminal of the water pressure control module through the resistor R4 to receive the control signal. A negative input terminal of the operational amplifier U3 is grounded through the resistor R1. An addition operation is performed on the operation result of the operational amplifier U9 and the control signal output by the water pressure control module through the operational amplifier U3. An addition operation result is transmitted to the pump control circuit through an output terminal OUT1 for a real-time balance adjustment of input and output water pressures.

The water pressure balance adjustment circuit comprises a plurality of balance modules and a second comparison module. Each of the plurality of balance modules corresponding to a cooling tower of the at least two cooling towers, and is configured to receive a water pressure detection signal sent by the water pressure detection module corresponding to the each of the plurality of balance modules and the water pressure control signal sent by the main control board. The second comparison module is configured to receive and compare output signals sent by the plurality of balance modules to obtain a second comparison result, and feed back the second comparison result to the main control board. The main control board is configured to adjust water output control signals according to the second comparison result to realize a balance of water outputs among the at least two cooling towers.

Figure 3:
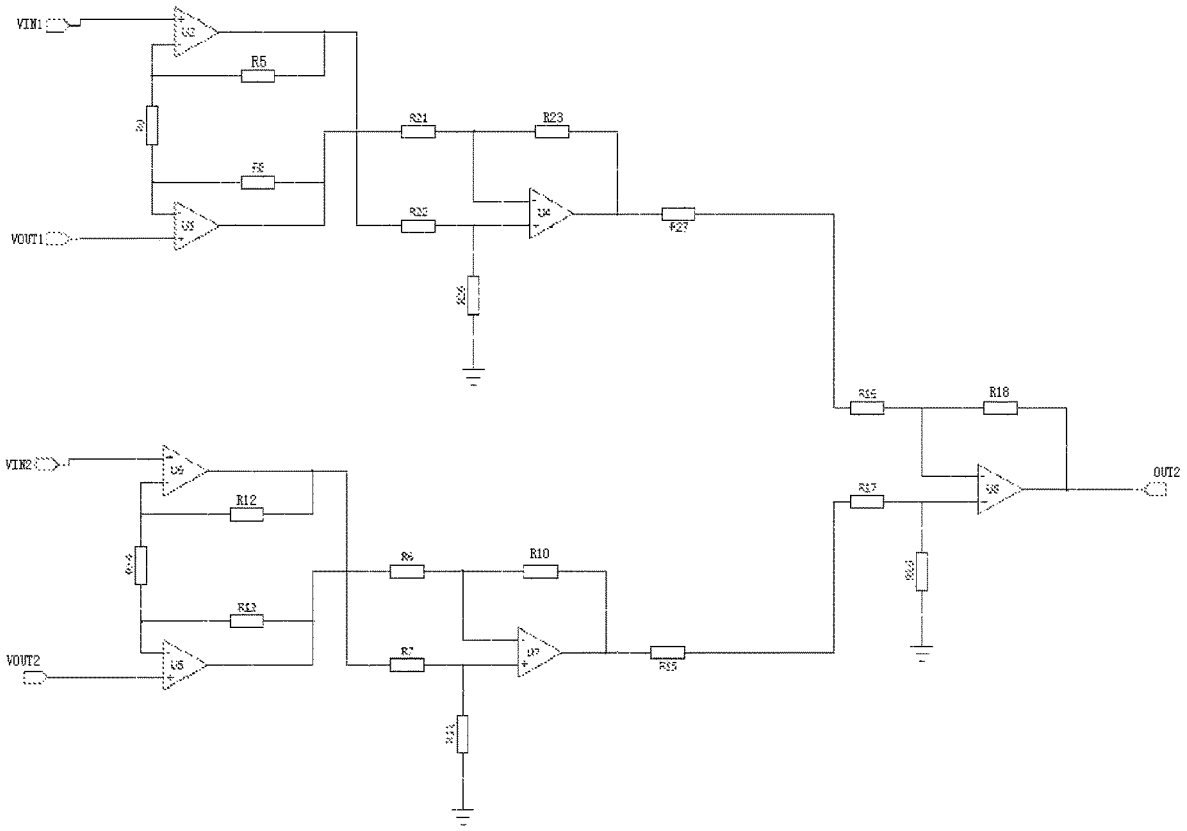
FIG. 3 is a circuit diagram of a water pressure balance adjustment circuit according to some embodiments of the present disclosure.

Taking the water chiller comprising two cooling towers used in parallel as an example, the structure of the water pressure balance adjustment circuit will be described. As shown in FIG. 3, the water pressure balance adjustment circuit is composed of two balance modules and a second comparison module. For example, two balance modules are disposed on two cooling towers respectively. The balance module 1 comprises: operational amplifiers U1, U2, U4, and resistors R5, R8, R9, R21, R22, R23, R26 and R27.A positive input terminal of the operational amplifier U2 is connected to the output terminal of the water pressure detection module to receive the water pressure detection signal. A negative input terminal of the operational amplifier U2 is connected to a negative input terminal of another operational amplifier U1 through the resistor R9. The water pressure detection signal is subjected to a signal extraction by the operational amplifier U2, and a extracted signal is send to a positive input terminal of the operational amplifier U4 through the resistor R22 from an output terminal of the operational amplifier U2. The output terminal of the operational amplifier U2 is connected to the negative input terminal of the operational amplifier U2 through the resistor R5. A positive input terminal of the operational amplifier U1 is connected to an output terminal of the main control board to receive a water pressure control signal. The water pressure control signal is subjected to a signal extraction by the operational amplifier U1, and a extracted signal is send to a negative input terminal of the operational amplifier U4 through the resistor R21. An output terminal of the operational amplifier U1 is connected to the negative input terminal of the operational amplifier U1 through the resistor R8. The positive input terminal of the operational amplifier U4 is further grounded through the resistor R26. The water pressure detection signal and the water pressure control signal of the cooling tower 1 are extracted by the operational amplifiers U2 and U1, and then are subjected to a signal calculation and an amplification of the operational amplifier U4, and then an output is send to the negative input terminal of the second comparison module from the output terminal of the operational amplifier U4 through the resistor R27. The output terminal of the operational amplifier U4 is further connected to the negative input terminal of the operational amplifier U4 through the resistor R23. The operational amplifier U4 is, for example, a differential amplifier.

The other balance module 2 is composed of operational amplifiers U5, U6, U7, input terminals VIN2, VOUT2, resistors R6, R7, R10, R11, R12, R13, R14 and R15. The circuit structure, connection and function of the balance module 2 are the same as those of the balance module 1. The water pressure detection signal and the water pressure control signal of the cooling tower 2 are extracted by the operational amplifiers U6 and U5, and then are subjected to a signal calculation and an amplification of the operational amplifier U7. Then, an output is send to the positive input terminal of the second comparison module from the output terminal of the operational amplifier U7 through the resistor R15. The operational amplifier U7 is, for example, a differential amplifier.

The second comparison module comprises: a negative input terminal of the second comparison module formed by a negative input terminal of an operational amplifier U8 through a resistor R16, which is connected to one end of the resistor R27 of the balance module 1; a positive input terminal of the second comparison module formed by a positive input terminal of the operational amplifier U8 through the resistor R17, which is connected to one end of a resistor R15 of the balance module 2, wherein the positive input terminal of the operational amplifier U8 is further grounded through the resistor R19; an output terminal OUT2 of the second comparison module formed by the output terminal of the operational amplifier U8, wherein the output terminal of the operational amplifier U8 is further connected to the negative input terminal of the operational amplifier U8 through the resistor R18. The second comparison module performs a subtraction operation on the signals received from the balance module 1 and the balance module 2, and transmits an operation result to the main control board through the output terminal of the second comparison module. The main control board sends a water pressure adjustment signal according to the operation result, so as to balance the water outputs of the two cooling towers, thereby avoiding potential safety hazards caused by abnormal water pressure during the operation of the two cooling towers.

Figure 4:
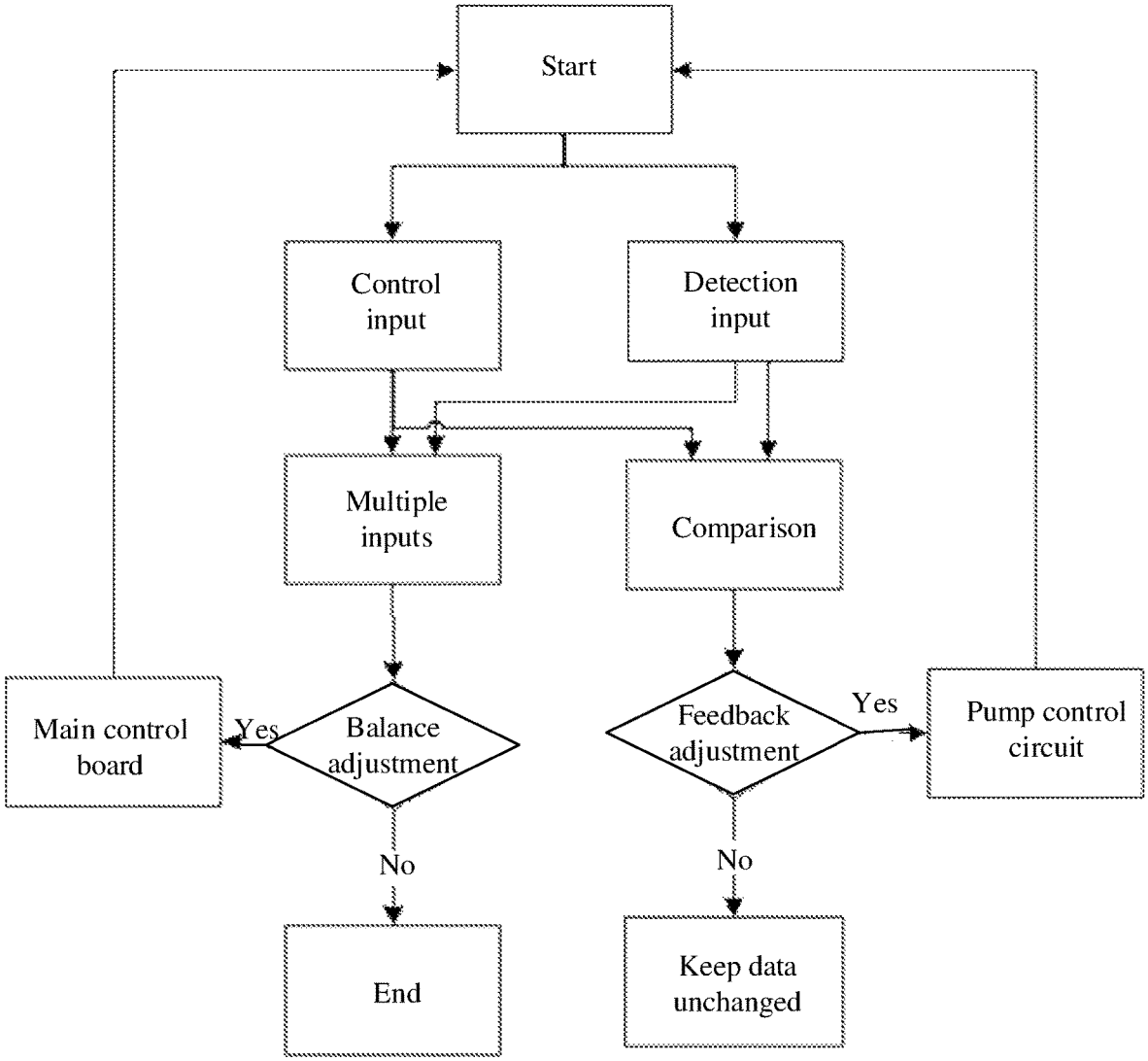
FIG. 4 is a control logic flowchart according to some embodiments of the present disclosure.

FIG. 4 is a control logic flowchart of a water output adjustment method. When a water chiller starts working, upon the main control board is powered on, the main control board outputs a water pressure control signal to the water pressure control modules corresponding to the cooling towers 1 and 2 respectively and the water pressure balance adjustment circuit, and receives water pressure detection signals from the water pressure detection modules corresponding to the two cooling towers. The water pressure detection modules further output the water pressure detection signals to the first comparison module and the water pressure balance adjustment circuit respectively. Further, the water pressure control module of each of the two cooling towers receives the water pressure control signal and outputs a control signal to the first comparison module. Further, the first comparison module of each of the two cooling towers compares the water pressure detection signal and the control signal to determine whether the input and output water pressures exceed a preset range. If the input and output water pressures exceed the preset range, a comparison result is output to a pump control circuit for water pressure adjustment. If the input and output water pressures do not exceed the preset range, the process directly returns to the initial step. Further, the water pressure balance adjustment circuit of the two cooling towers extracts the water pressure detection signals and the water pressure control signal, amplifies the extracted signals and inputs them to the second comparison module. Further, the second comparison module compares the amplified signals and transmits a comparison result to the main control board. Further, the main control board determines whether the water pressures are balanced between the two cooling towers. If the water pressures are unbalanced, the main control board will send a water pressure adjustment signal for a water pressure balance adjustment. If the water pressures are balanced, no operate will be taken.

Figure 5:
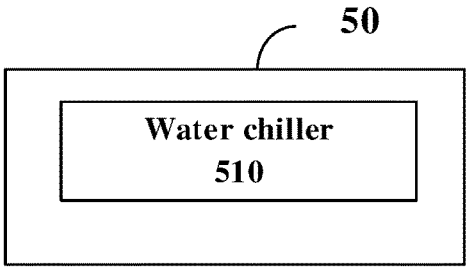
FIG. 5 is a structural diagram of an air conditioning system according to some embodiments of the present disclosure.

In some embodiments, an air conditioning system is provided, in which the water chiller and the water output adjustment method of the present disclosure are applied. As shown in FIG. 5, the air conditioning system 50 comprises: a water chiller 510. In some embodiments, the water chiller 510 is implemented in the same or similar scheme as the water chiller described in the foregoing embodiments.

The disclosure further provides a water output adjustment method of a water chiller, which will be described below with reference to FIG. 6.

Figure 6:
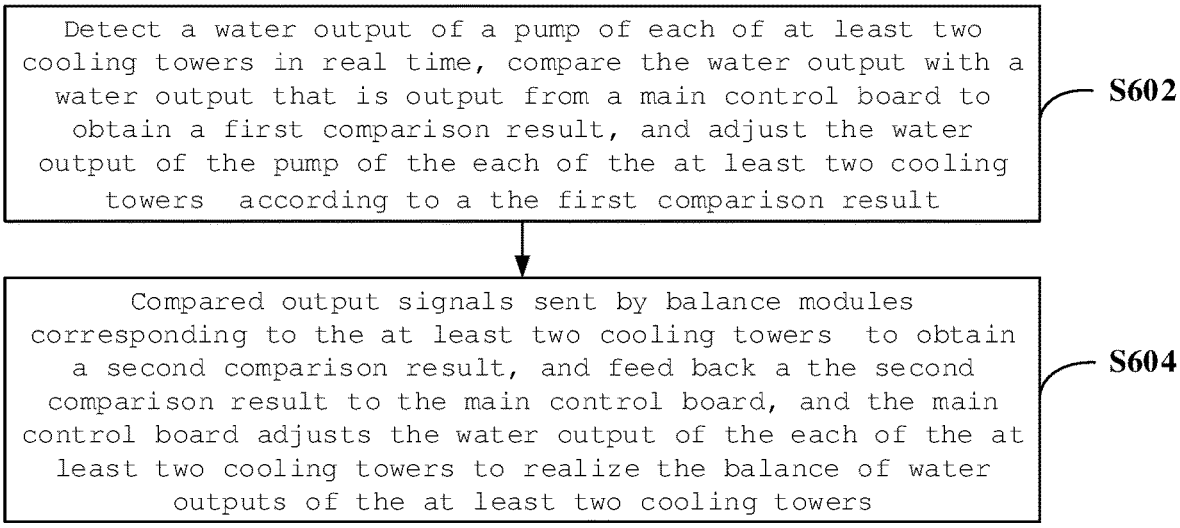
FIG. 6 is a flow diagram of a water output adjustment method of a water chiller according to some embodiments of the present disclosure.

FIG. 6 is a flowchart of a water adjustment method of a water chiller according to some embodiments of the present disclosure. As shown in FIG. 6, the method of this embodiment comprises: steps S602 to S604.

In step S602, a water output of a pump of each of at least two cooling towers is detected in real time, and is compared with a water output that is output from a main control board to obtain a first comparison result, and the water output of the pump of the each of the at least two cooling towers is adjusted according to the first comparison result.

In step S604, output signals sent by balance modules corresponding to the at least two cooling towers are compared to obtain a second comparison result, and the second comparison result is fed back to the main control board, wherein the main control board adjusts the water output of the each of the at least two cooling towers to realize the balance of water outputs of the at least two cooling towers.

Other embodiments of the water output adjustment method of the present disclosure will be described below with reference to FIG. 7.

Figure 7:
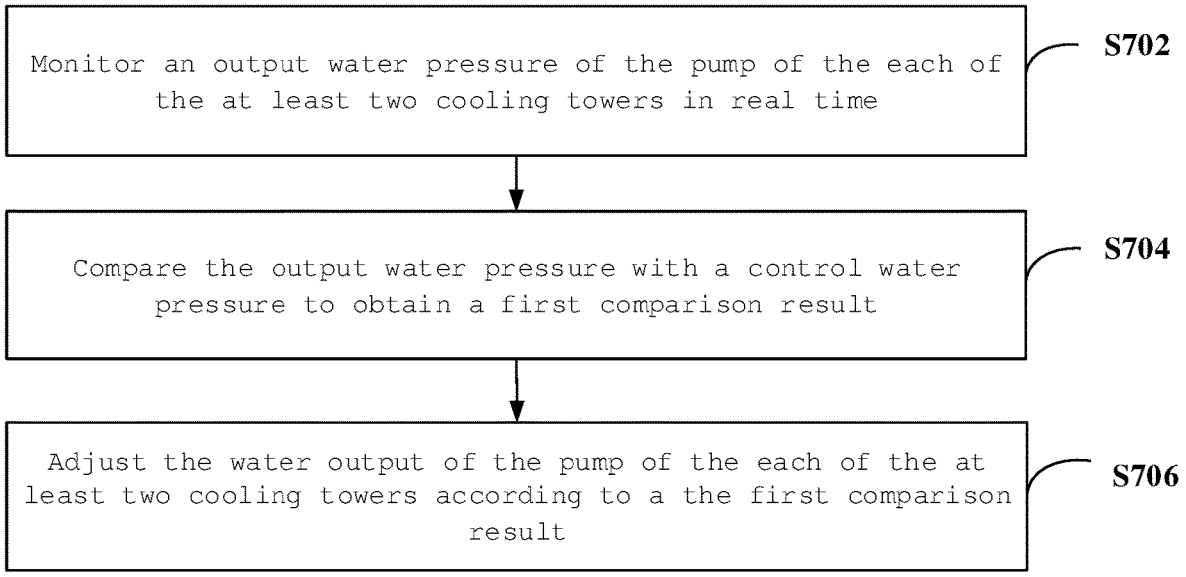
FIG. 7 is a flow diagram of a water output adjustment method of a water chiller according to other embodiments of the present disclosure.

FIG. 7 is a flowchart of a water adjustment method of a water chiller according to other embodiments of the present disclosure. As shown in FIG. 7, the method of this embodiment comprises: performing steps S702 to S706 for a pump of each of at least two cooling towers.

In step S702, an output water pressure of the pump of the each of the at least two cooling towers is monitored in real time.

In step S704, the output water pressure is compared with a control water pressure to obtain a first comparison result.

In step S706, the water output of the pump of the each of the at least two cooling towers is adjusted according to the first comparison result.

In some embodiments, the method further comprising: comparing output signals sent by balance modules corresponding to the at least two cooling towers to obtain a second comparison result, and feeding back the second comparison result to the main control board, wherein the main control board adjusts the water output of each of the at least two cooling towers to realize a balance of water outputs among the at least two cooling towers, and each of the balance modules corresponds to one of the at least two cooling towers.

Other embodiments of the water output adjustment method of the present disclosure will be described below with reference to FIG. 8.

Figure 8:
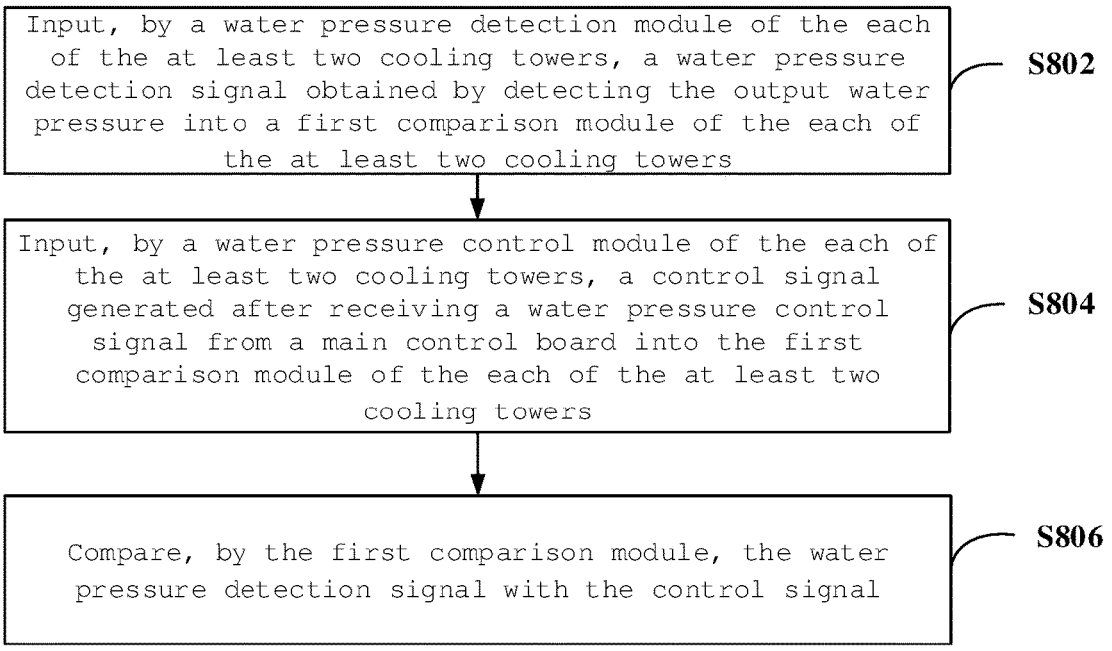
FIG. 8 is a flow diagram of a water output adjustment method of a water chiller according to still other embodiments of the present disclosure.

FIG. 8 is a flowchart of a water adjustment method of a water chiller according to still other embodiments of the present disclosure. As shown in FIG. 8, step S704 comprises: steps S802 to S806.

In step S802, a water pressure detection module of the each of the at least two cooling towers inputs a water pressure detection signal obtained by detecting the output water pressure into a first comparison module of the each of the at least two cooling towers.

In step S804, a water pressure control module of the each of the at least two cooling towers inputs a control signal generated after receiving a water pressure control signal from a main control board into the first comparison module of the each of the at least two cooling towers, wherein the control signal is used to represent the control water pressure.

In some embodiments, steps S802 and S804 are performed in parallel, in no particular order.

In step S806, the first comparison module compares the water pressure detection signal with the control signal.

Other embodiments of the water output adjustment method of the present disclosure will be described below with reference to FIG. 9.

Figure 9:
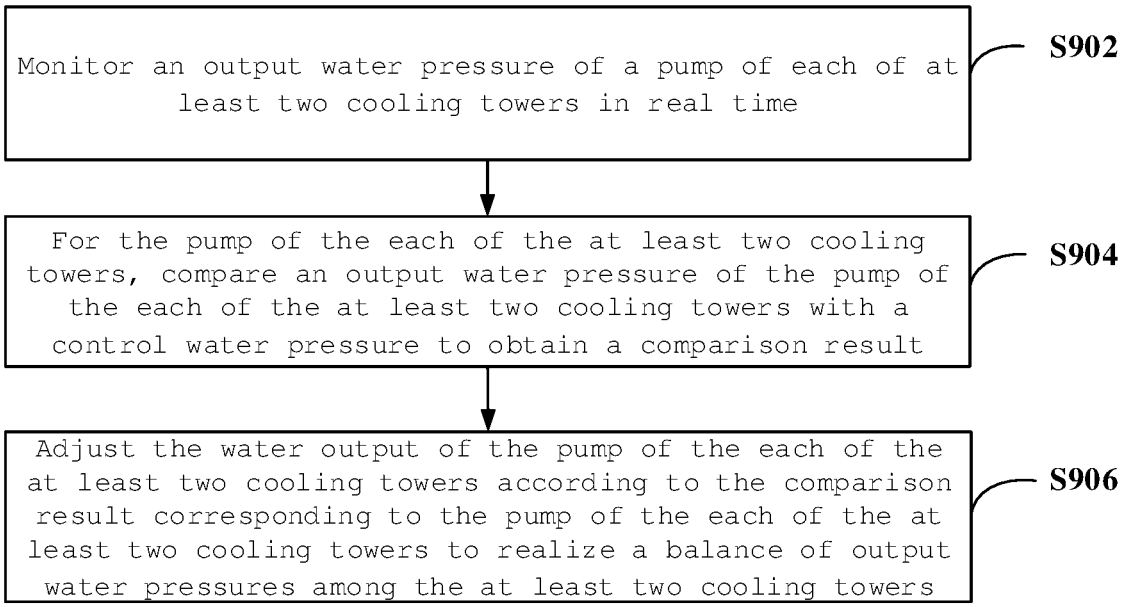
FIG. 9 is a flow diagram of a water output adjustment method of a water chiller according to still other embodiments of the present disclosure.

FIG. 9 is a flowchart of a water adjustment method of a water chiller according to further embodiments of the present disclosure. As shown in FIG. 9, the method of this embodiment comprises: steps S902 to S906.

In step S902, an output water pressure of a pump of each of at least two cooling towers is monitored in real time.

In step S904, for the pump of the each of the at least two cooling towers, an output water pressure of the pump of the each of the at least two cooling towers is compared with a control water pressure to obtain a comparison result.

In step S906, the water output of the pump of the each of the at least two cooling towers is adjusted according to the comparison result corresponding to the pump of the each of the at least two cooling towers to realize a balance of output water pressures among the at least two cooling towers.

Other embodiments of the water output adjustment method of the present disclosure will be described below with reference to FIG. 10.

Figure 10:
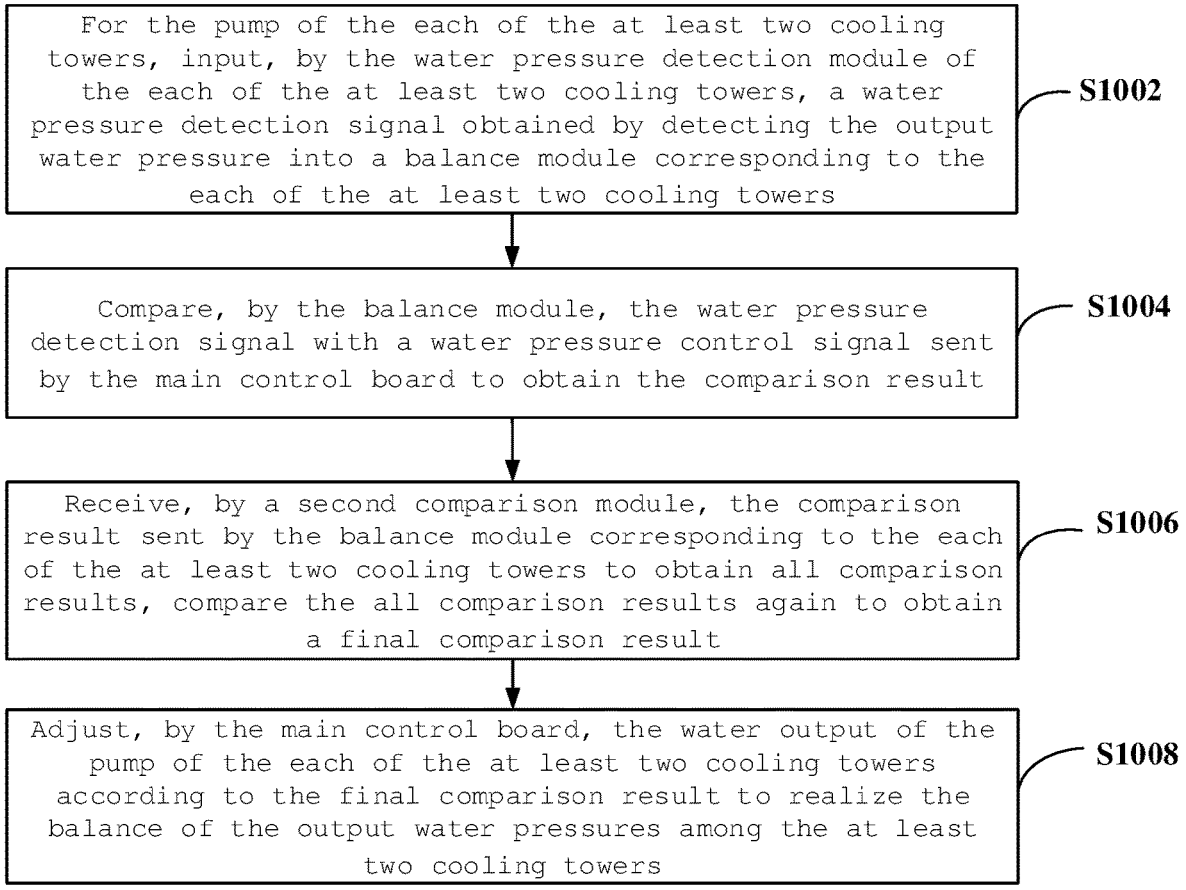
FIG. 10 is a flow diagram of a water output adjustment method of a water chiller according to still other embodiments of the present disclosure.

FIG. 10 is a flowchart of a water adjustment method of a water chiller according to still other embodiments of the present disclosure. As shown in FIG. 10, step S904 comprises: steps S1002 to S1004. Step S906 comprises: steps S1006 to S1008.

In step S1002, for the pump of the each of the at least two cooling towers, the water pressure detection module of the each of the at least two cooling towers inputs a water pressure detection signal obtained by detecting the output water pressure into a balance module corresponding to the each of the at least two cooling towers.

In step S1004, the balance module corresponding to the pump of the each of the at least two cooling towers compares the water pressure detection signal with a water pressure control signal sent by the main control board to obtain the comparison result.

In step S1006, a second comparison module receives the comparison result sent by the balance module corresponding to the each of the at least two cooling towers to obtain all comparison results, comparing the all comparison results again to obtain a final comparison result, and sending the final comparison result to the main control board.

In step S1008, the main control board adjusts the water output of the pump of the each of the at least two cooling towers according to the final comparison result to realize the balance of the output water pressures among the at least two cooling towers.

The present disclosure provides a water chiller, a water output adjustment method and an air conditioning system. through detecting input and output water pressures of the water chiller and comparing them with a control water pressure, a water pressure adjustment is performed on the water chiller in real time, and the detected input and output water pressures are fed back to a main control board of the water chiller, which realizes a balance adjustment of the input and output water pressures through control logic to ensure the balance of cooling water outputs. Through extracting the input and output water pressures of multiple cooling towers and comparing them with a control water pressure, a balance adjustment of the input and output water pressures is achieved for multiple cooling towers, thereby avoiding potential safety hazards caused by abnormal water pressure during the operation of the water chiller.

Those skilled in the art should understand that the embodiments of the present disclosure are provided, for example, as a method, a system, or a computer program product. Therefore, embodiments of the present disclosure, for example, take the form of an entirely hardware embodiment, an entirely software embodiment or an embodiment containing both hardware and software elements. Moreover, the present disclosure, for example, take the form of a computer program product embodied on one or more computer-usable non-transitory storage media (comprising but not limited to disk storage, CD-ROM, optical memory, etc.) having computer-usable program code embodied therein.

The present disclosure is described with reference to flowcharts and/or block diagrams of methods, apparatuses (systems) and computer program products according to embodiments of the present disclosure. It should be understood that each process and/or block in the flowcharts and/or block diagrams, and combinations of the processes and/or blocks in the flowcharts and/or block diagrams are implemented by computer program instructions. In some embodiments, the computer program instructions are provided to a processor of a general purpose computer, a special purpose computer, an embedded processor, or other programmable data processing device to generate a machine such that the instructions executed by a processor of a computer or other programmable data processing device to generate means implementing the functions specified in one or more flows of the flowcharts and/or one or more blocks of the block diagrams.

In some embodiments, the computer program instructions are also stored in a computer readable memory device capable of directing a computer or other programmable data processing device to operate in a specific manner such that the instructions stored in the computer readable memory device produce an article of manufacture comprising instruction means implementing the functions specified in one or more flows of the flowcharts and/or one or more blocks of the block diagrams.

In some embodiments, these computer program instructions are also loaded onto a computer or other programmable device to perform a series of operation steps on the computer or other programmable device to generate a computer-implemented process such that the instructions executed on the computer or other programmable device provide steps implementing the functions specified in one or more flows of the flowcharts and/or one or more blocks of the block diagrams.

The above is merely preferred embodiments of this disclosure, and is not limitation to this disclosure. Within spirit and principles of this disclosure, any modification, replacement, improvement and etc shall be contained in the protection scope of this disclosure.

What is claimed is:

1. A water chiller, comprising: at least two cooling towers used in parallel, a water pressure balance adjustment circuit, and a main control board, wherein each of the at least two cooling towers comprises a water pressure pre-adjustment circuit, the main control board is configured to control the water pressure pre-adjustment circuit to realize real-time water output adjustment of the each of the at least two cooling towers, and control the water pressure balance adjustment circuit to achieve a water output balance adjustment among multiple cooling towers, wherein the water pressure pre-adjustment circuit comprises: a water pressure detection module, a water pressure control module and a first comparison module, wherein the water pressure control module receives a water pressure control signal from the main control board and outputs a control signal, and the first comparison module is configured to compare the control signal output by the water pressure control module with a water pressure detection signal output by the water pressure detection module to obtain a first comparison result, and output a water output adjustment signal to a pump of the each of the at least two cooling towers according to the first comparison result.

2. The water chiller according to claim 1, wherein the first comparison module comprises a subtractor and an adder, input signals of the subtractor are the control signal output by the water pressure control module and the water pressure detection signal output by the water pressure detection module respectively, an output signal of the subtractor and the control signal output by the water pressure control module are used as input signals of the adder, and the water output adjustment signal is output from an output terminal of the adder.

3. The water chiller according to claim 2, wherein the subtractor comprises: an operational amplifier U9, a negative input terminal of the operational amplifier U9 is connected to an output terminal of the water pressure detection module through a resistor R38, a positive input terminal of the operational amplifier U9 is connected to an output terminal of the water pressure control module through a resistor R33, the positive input terminal of the operational amplifier U9 is further grounded through a resistor R34, an output terminal of the operational amplifier U9 is connected to the adder, and the output terminal of the operational amplifier U9 is further connected to the negative input terminal of the operational amplifier U9 through a resistor R39.

4. The water chiller according to claim 2, wherein the adder comprises: an operational amplifier U3, a positive input terminal of the operational amplifier U3 is connected to an output terminal of the subtractor through a resistor R3, the positive input terminal of the operational amplifier U3 is further connected to an output terminal of the water pressure control module through a resistor R4, a negative input terminal of the operational amplifier U3 is grounded through a resistor R1, and the water output adjustment signal is output from an output terminal of the operational amplifier U3.

5. The water chiller according to claim 1, wherein the water pressure balance adjustment circuit comprises:

a plurality of balance modules, each of the plurality of balance modules corresponding to a cooling tower of the at least two cooling towers, and configured to receive a water pressure detection signal sent by the water pressure detection module corresponding to the each of the plurality of balance modules and the water pressure control signal sent by the main control board; and a second comparison module configured to receive and compare output signals sent by the plurality of balance modules to obtain a second comparison result, and feed back the second comparison result to the main control board;

wherein the main control board adjusts water output control signals according to the second comparison result to realize a balance of water outputs among the at least two cooling towers.

6. The water chiller according to claim 5, wherein one of the plurality of balance modules comprises: an operational amplifier U1, an operational amplifier U2, and an operational amplifier U4, wherein:

a positive input terminal of the operational amplifier U2 is connected to an output terminal of the water pressure detection module, a negative input terminal of the operational amplifier U2 is connected to a negative input terminal of the operational amplifier U1 through a resistor R9, an output terminal of the operational amplifier U2 is connected to a positive input terminal of the operational amplifier U4 through a resistor R22, and the output terminal of the operational amplifier U2 is further connected to the negative input terminal of the operational amplifier U2 through a resistor R5;

a positive input terminal of the operational amplifier U1 is connected to an output terminal of the main control board, an output terminal of the operational amplifier U1 is connected to the negative input terminal of the operational amplifier U4 through a resistor R21, and the output terminal of the operational amplifier U1 is connected to the negative input terminal of the operational amplifier U1 through a resistor R8;

a positive input terminal of the operational amplifier U4 is grounded through a resistor R26, an output terminal of the operational amplifier U4 is connected to an input terminal of the second comparison module through a resistor R27, and the output terminal of the operational amplifier U4 is further connected to the negative input terminal of the operational amplifier U4 through a resistor R23.

7. The water chiller according to claim 5, wherein the second comparison module comprises: an operational amplifier U8, a negative input terminal of the operational amplifier U8 is connected to an output terminal of one of the plurality of balance modules through a resistor R16, a positive input terminal of the operational amplifier U8 is connected to an output terminal of another one of the plurality of balance modules through a resistor R17, the positive input terminal of the operational amplifier U8 is further grounded through a resistor R19, and an output terminal of the operational amplifier U8 feeds back the comparison result to the main control board, and the output terminal of the operational amplifier U8 is further connected to the negative input terminal of the operational amplifier U8 through a resistor R18.

8. The water chiller according to claim 6, wherein the operational amplifier U4 is a differential amplifier.

9. A water output adjustment method of a water chiller, wherein the water chiller comprises at least two cooling towers used in parallel, a water pressure balance adjustment circuit, and a main control board, each of the at least two cooling towers comprises a water pressure pre-adjustment circuit, and the water output adjustment method comprises:

controlling, by the main control board, the water pressure pre-adjustment circuit to realize real-time water output adjustment of the each of the at least two cooling towers, and control, by the main control board, the water pre sure balance adjustment circuit to achieve a water output balance adjustment among multiple cooling towers, wherein the water pressure pre-adjustment circuit comprises a water pressure detection module, a water pressure control module and a first comparison module, and the controlling, by the main control board, the water pressure pre-adjustment circuit to realize real-time water output adjustment of the each of least two cc towers comprises:

receiving, by the water pressure control module, a water pressure control signal from the main control board and outputting, by the water pressure control module, a control signal; and comparing, by the first comparison module, the control signal output by the water pressure control module with a water pressure detection signal output by the water pressure detection module to brain a first comparison result, and outputting, by the first comparison module, a water output adjustment signal to a pomp of the each of the at least two cooling towers according to the first comparison result.

10. The water output adjustment method according to claim 9, wherein the water pressure balance adjustment circuit comprises a plurality of balance modules and a second comparison module, each of the plurality of balance modules corresponding to a cooling tower of the at least two cooling towers, and the comparing the output water pressure with the control water pressure comprises:

receiving, by the each of the plurality of balance modules, a water pressure detection signal sent by the water pressure detection module corresponding to the each of the plurality of balance modules and the water pressure control signal sent by the main control board;

receiving and comparing, by the second comparison module, output signals sent by the plurality of balance modules to obtain a second comparison result, and feeding back, by the second comparison module, the second comparison result to the main control board; and adjusting, by the main control board, water output control signals according to the second comparison result to realize a balance of water outputs among the at least two cooling towers.

11. A water output adjustment method of a water chiller, comprising:

monitoring an output water pressure of a pump of each of at least two cooling towers in real time;

for the pump of the each of the at least two cooling towers, comparing an output water pressure of the pump of the each of the at least two cooling towers with a control water pressure to obtain a comparison result;

adjusting the water output of the pump of the each of the at least two cooling towers according to the comparison result corresponding to the pump of the each of the at least two cooling towers to realize a balance of output water pressures among the at least two cooling towers.

12. The water output adjustment method according to claim 11, wherein for the pump of the each of the at least two cooling towers, comparing an output water pressure of the pump of the each of the at least two cooling towers with a control water pressure to obtain a comparison result comprises:

for the pump of the each of the at least two cooling towers, inputting, by the water pressure detection module of the each of the at least two cooling towers, a water pressure detection signal obtained by detecting the output water pressure into a balance module corresponding to the each of the at least two cooling towers;

comparing, by the balance module, the water pressure detection signal with a water pressure control signal sent by the main control board to obtain the comparison result;

wherein adjusting the water output of the pump of the each of the at least two cooling towers according to the comparison result corresponding to the pump of the each of the at least two cooling towers to realize a balance of output water pressures among the at least two cooling towers comprises:

receiving, by a second comparison module, the comparison result sent by the balance module corresponding to the each of the at least two cooling towers to obtain all comparison results, comparing the all comparison results again to obtain a final comparison result, and sending the final comparison result to the main control board;

adjusting, by the main control board, the water output of the pump of the each of the at least two cooling towers according to the final comparison result to realize the balance of the output water pressures among the at least two cooling towers.

13. An air conditioning system, wherein the air conditioning system comprises a water chiller according to claim 1.

14. The air conditioning system according to claim 13, wherein the water pressure pre-adjustment circuit comprises: a water pressure detection module, a water pressure control module and a first comparison module, wherein the water pressure control module receives a water pressure control signal from the main control board and outputs a control signal, and the first comparison module is configured to compare the control signal output by the water pressure control module with a water pressure detection signal output by the water pressure detection module to obtain a first comparison result, and output a water output adjustment signal to a pump of the each of the at least two cooling towers according to the first comparison result.

15. The air conditioning system according to claim 14, wherein the first comparison module comprises a subtractor and an adder, input signals of the subtractor are the control signal output by the water pressure control module and the water pressure detection signal output by the water pressure detection module respectively, an output signal of the subtractor and the control signal output by the water pressure control module are used as input signals of the adder, and the water output adjustment signal is output from an output terminal of the adder.

16. The air conditioning system according to claim 15, wherein the subtractor comprises: an operational amplifier U9, a negative input terminal of the operational amplifier U9 is connected to an output terminal of the water pressure detection module through a resistor R38, a positive input terminal of the operational amplifier U9 is connected to an output terminal of the water pressure control module through a resistor R33, the positive input terminal of the operational amplifier U9 is further grounded through a resistor R34, an output terminal of the operational amplifier U9 is connected to the adder, and the output terminal of the operational amplifier U9 is further connected to the negative input terminal of the operational amplifier U9 through a resistor R39.

17. The air conditioning system according to claim 15, wherein the adder comprises: an operational amplifier U3, a positive input terminal of the operational amplifier U3 is connected to an output terminal of the subtractor through a resistor R3, the positive input terminal of the operational amplifier U3 is further connected to an output terminal of the water pressure control module through a resistor R4, a negative input terminal of the operational amplifier U3 is grounded through a resistor R1, and the water output adjustment signal is output from an output terminal of the operational amplifier U3.

18. The air conditioning system according to claim 14, wherein the water pressure balance adjustment circuit comprises:

a plurality of balance modules, each of the plurality of balance modules corresponding to a cooling tower of the at least two cooling towers, and configured to receive a water pressure detection signal sent by the water pressure detection module corresponding to the each of the plurality of balance modules and the water pressure control signal sent by the main control board; and a second comparison module configured to receive and compare output signals sent by the plurality of balance modules to obtain a second comparison result, and feed back the second comparison result to the main control board;

wherein the main control board adjusts water output control signals according to the second comparison result to realize a balance of water outputs among the at least two cooling towers.

19. The water output adjustment method according to claim 9, further comprising:

comparing output signals sent by balance modules corresponding to the at least two cooling towers to obtain a second comparison result, and feeding back the second comparison result to the main control board, wherein the main control board adjusts the water output of each of the at least two cooling towers to realize a balance of water outputs among the at least two cooling towers, and each of the balance modules corresponds to one of the at least two cooling towers.

20. The air conditioning system conditioning to claim 18, wherein one of the plurality of balance modules comprises: an operational amplifier U1, an operational amplifier U2, and an operational U4, wherein:

a positive input terminal of the operational amplifier U2 is connected to an output terminal of the water pressure detection module, a negative put terminal of the operational amplifier U2 is connected to a negative input terminal of the operational amplifier U1 through a resistor R9, an output terminal of the operational amplifier U2 is connected to a positive input terminal of the operational amplifier U4 through a resistor R22, and the output terminal of the operational amplifier U2 is further connected to the negative input terminal of the operational amplifier U2 through a resistor R22R5;

a positive input terminal of the operational amplifier U1 is connected to an output terminal of the main control board, an output terminal of the operational amplifier U1 is connected to the negative input terminal of the operational amplifier U4 through a resistor R21, and the output terminal of the operational amplifier U1 is connected to the negative input terminal of the operational amplifier U1 through a resistor R8;

a positive input terminal of the operational amplifier U4 is grounded through a resistor R26, an output terminal of the operational amplifier U4 is connected to an input terminal of the second comparison module through a resistor R27, and the output terminal of the operational amplifier U4 is further connected to the negative input terminal of the operational amplifier U4 through a resistor R23.

* * * * *